US006363596B1

(12) United States Patent
Reiter et al.

(10) Patent No.: US 6,363,596 B1
(45) Date of Patent: Apr. 2, 2002

(54) MOUNTING/DEMOUNTING DEVICE FOR MOUNTING AND/OR DEMOUNTING A FUEL INJECTION VALVE

(75) Inventors: Ferdinand Reiter; Heinz-Martin Krause, both of Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/674,220

(22) PCT Filed: Sep. 30, 1999

(86) PCT No.: PCT/DE99/03142

§ 371 Date: Dec. 21, 2000

§ 102(e) Date: Dec. 21, 2000

(87) PCT Pub. No.: WO00/52327

PCT Pub. Date: Sep. 8, 2000

(30) Foreign Application Priority Data

Feb. 27, 1999 (DE) ..... 199 08 573

(51) Int. Cl.[7] ..... B25B 27/14

(52) U.S. Cl. ..... 29/278; 29/263; 29/280; 29/255

(58) Field of Search ..... 29/278, 280, 282, 29/255, 260, 240, 214, 263

(56) References Cited

U.S. PATENT DOCUMENTS 714,989 A * 12/1902 Worthington ..... 29/278
2,234,824 A * 3/1941 Kingston ..... 29/263
3,210,836 A * 10/1965 Johanson et al. ..... 29/263
3,739,452 A 6/1973 Gadberry
4,050,148 A * 9/1977 Hastings ..... 29/278
4,052,788 A * 10/1977 Hastings ..... 29/278
4,561,159 A 12/1985 Schuster
4,904,010 A * 2/1990 Lacey et al. ..... 29/278
5,253,408 A 10/1993 Wright

FOREIGN PATENT DOCUMENTS

DE 197 05 990 8/1998
WO WO81/02538 9/1981

* cited by examiner

*Primary Examiner*—Joseph J. Hail, III
*Assistant Examiner*—Lee Wilson
(74) *Attorney, Agent, or Firm*—Kenyon & Kenyon

(57) ABSTRACT

An installation/removal device is used to install and remove a fuel injector in/from a receiving bore hole of an internal-combustion-engine cylinder head. The installation/removal device includes a sheathing member having a tubular section and a contacting section, which acts on and/or contacts the fuel injector by a contact surface that extends radially inwardly. The contacting section, which can be formed by at least two elastic, contacting subsections separated from each other by cut-outs, is adjustable between an engaged position; in which a frictional connection to the fuel injector can be established, and a released position in which the installation/removal device can be removed from the fuel injector.

10 Claims, 6 Drawing Sheets

MOUNTING/DEMOUNTING DEVICE FOR MOUNTING AND/OR DEMOUNTING A FUEL INJECTION VALVE

FIELD OF THE INVENTION

The present invention relates to an installation/removal device for installing and/or removing a fuel injector, especially a high-pressure, direct-injection valve, in/from a receiving bore hole of an internal-combustion-engine cylinder head. The high-pressure, direct-injection valve injects fuel directly into the combustion chamber of the internal combustion engine.

BACKGROUND INFORMATION

A removal device for removing a direct-injection injector is described, for example, in German published Patent Application No. 197 05 990. The removal device has a sheathing member, which at least partially surrounds the fuel injector and must already be inserted into the receiving bore hole, together with the fuel injector, during assembly. At a first end of the sleeve member, a first collar section is provided, which can be frictionally connected to a fuel-injector receiving section that receives the first collar section. A second collar section offering a working surface for a tool is located at a second end of the sheathing member opposite to the first end. A disadvantage of this removal device is that the connection of the removal device to the fuel injector is not optimized, and the introduction of force by the tool acting on the removal device can be improved. Another disadvantage is that the removal device must already be attached to the fuel injector prior to installation and cannot just be attached subsequently, e.g., when servicing or replacing. Furthermore, the tool can only be used for removing the fuel injector and not for installing it.

A removal device for a diesel injection nozzle is described in U.S. Pat. No. 4,561,159. A fuel-injector end area opposite to the spray-discharge opening can be inserted into a slit of the removal device. In this case, the removal device is not inserted into the receiving bore hole of the cylinder head, and in the installed state, it does not remain in the receiving bore hole. The removal device described in U.S. Pat. No. 4,561,159 is rather a tool extension, which is fastened to the fuel injector prior to removing the fuel injector. However, the connection of the removal device to the fuel injector is relatively complicated. In addition, this tool can also only be used for removal purposes.

SUMMARY

The installation/removal device according to the present invention has the advantage of being easily mountable on the fuel injector and being removable again, which allows the fuel injector to be easily installed and removed at the cylinder head of the internal combustion engine. This considerably simplifies maintenance work done on the fuel injector. The installation/removal device according to the present invention includes a sheathing member having a tubular section and a contacting section; the contacting section acting on the fuel injector by means of a contact area extending radially inward, and being adjustable between an engaged position, in which a frictional connection to the fuel injector can be established, and a released position, in which the installation/removal device can be removed from the fuel injector.

Advantageous further refinements and improvements of the installation/removal device are also possible.

The contacting section can be formed by at least two elastic, contacting subsections, which are separated from each other by cut-outs and can be deformed in a radial direction, using an adjusting mechanism. Thus, it is possible to adjust between the engaged position and released position in an especially simple manner.

The adjusting mechanism can include an inner section, which can be inserted into the sheathing member, can rotate with respect to it, and has a cam section acting on the elastic contacting subsections. The radial position of the contacting-subsection ends that act on a groove of the fuel injector is changed as a function of the turning position of the cam section. This design facilitates handling and allows a sturdy construction of the installation/removal device.

The inner section is advantageously provided with bore holes, and the sheathing member is provided with oblong openings formed in the axial direction in the same position as these bore holes, in order to attach a tool, such as a pin. The pin allows a large force to be exerted on the inner section. In addition, this facilitates the operation of the installation/removal device, especially in areas in the engine compartment that are difficult to access.

Alternatively, the adjusting mechanism may have a two-piece construction including a gripping part, which is attachable to the sheathing member and can rotate with respect to it, and a cam section, which can be detachably joined to the gripping part. Since the gripping part is mounted on the sheathing member of the installation/removal device, it is directly accessible. Therefore, it is not necessary to have an oblong opening in the sheathing member, which could decrease the rigidity of the tool. The gripping part is preferably provided with bore holes for attaching a tool, such as a pin.

The installation/removal device preferably has plugs disposed on the front end of the contacting sections, in order to axially support the installation/removal device at the valve housing during installation. These plugs allow compressive forces to be exerted by the installation/removal device on the fuel injector and thus enable the injector to be mounted securely.

In addition, the installation/removal device may have inclined deflectors attached to the inside of the contacting subsections, in order to provide support at the corresponding guide surfaces on the outside of the fuel injector. To attach the installation/removal device for the purpose of removing a fuel injector, it is therefore not necessary to operate the adjusting mechanism for adjusting the contacting section. The sliding of the gliding surfaces along the corresponding guide surfaces on the fuel injector allows the front ends of the contacting sections to reach the groove formed on the fuel injector, and to snap into place, by means of the inwardly jutting contact area.

The installation/removal device may be manufactured from sheet metal by rolling. However, it is also possible to manufacture the installation/removal device or parts thereof from a plastic reinforced with fiber glass, e.g., using an injection molding process.

DETAILED DESCRIPTION

Figure 1:
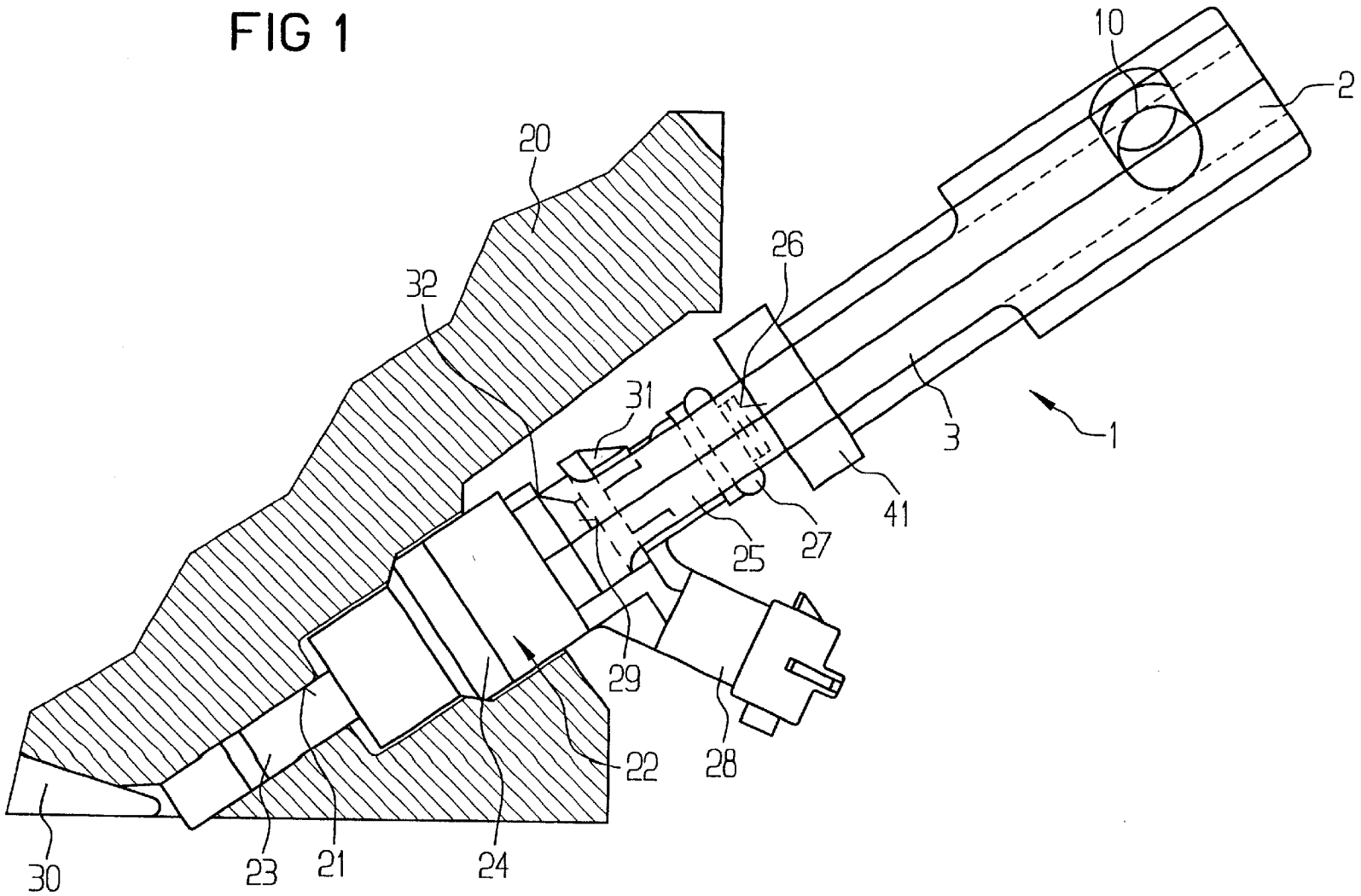
FIG. 1 is a side view of an installation/removal device according to the present invention mounted on a fuel injector, which is inserted into a receiving bore hole of a cylinder head, shown in cross-section.

FIG. 1 shows a first exemplary embodiment of an installation/removal device according to the present invention, the installation/removal device being in an engaged position at a cylinder head, of which a sectional view is shown. A fuel injector 22 used to directly inject fuel into a combustion chamber 30 of the internal combustion engine is inserted into a receiving bore hole 21 of cylinder head 20. Fuel injector 22 has a spray-discharge section 23, an intermediate section 24, and an inlet section 25. Inlet section 25 of fuel injector 22 has a fuel-intake orifice 26, which can be connected to a fuel distribution line not shown, and is sealed by a sealing ring 27.

Figure 2A:
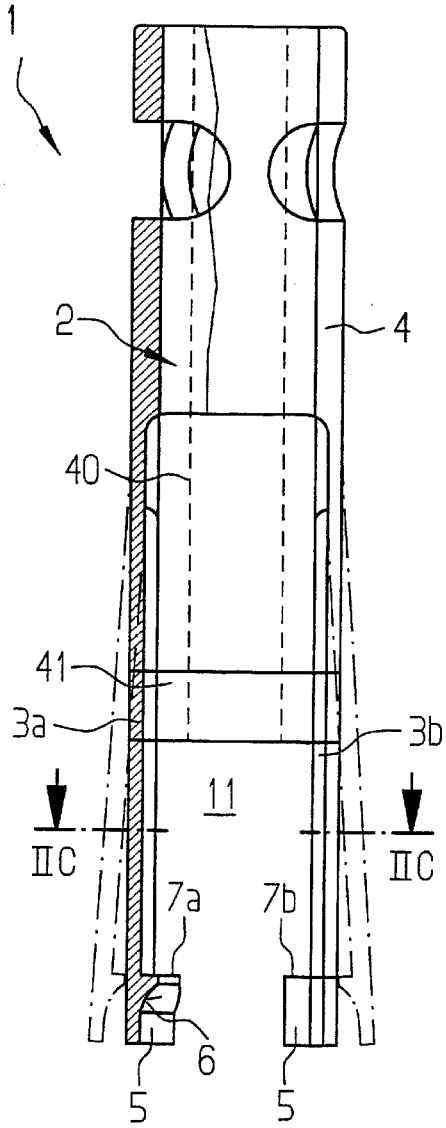
FIG. 2A is a front view, partially in section, of a first exemplary embodiment of an installation/removal device according to the present invention.
Figure 2B:
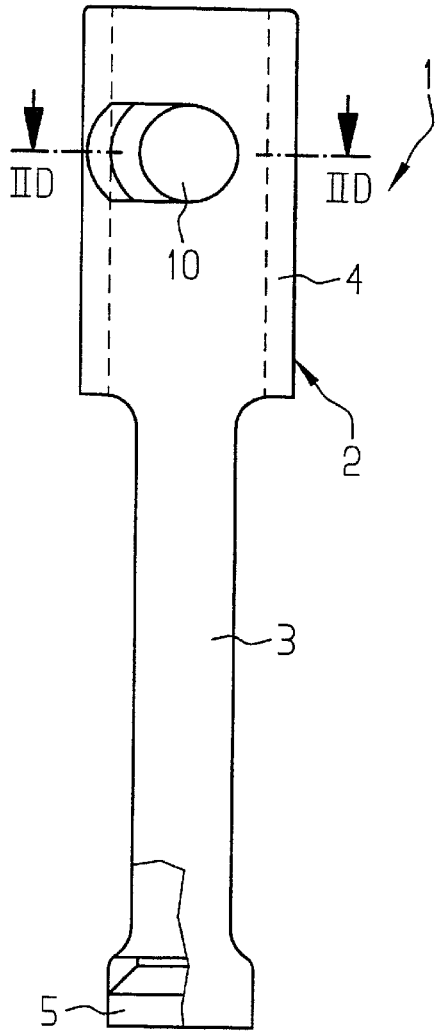
FIG. 2B is a side view of the installation/removal device illustrated in FIG. 2A.
Figure 2C:
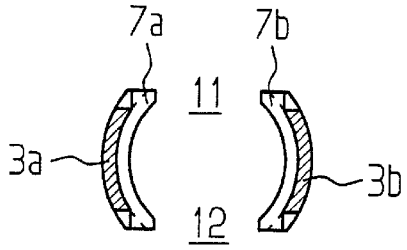
FIG. 2C is a sectional view of the installation/removal device taken along the line IIC—IIC shown in FIG. 2A.
Figure 2D:
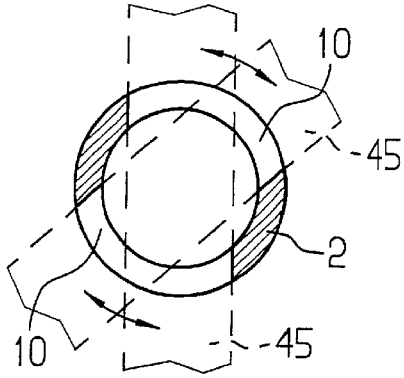
FIG. 2D is a sectional view of the installation/removal device taken along the line IID—IID shown in FIG. 2B.

An electrical connecting cable not shown, which can be connected to a plug connector 28, is used to electrically operate fuel injector 22. As an example, plug connector 28 can be injection-molded at fuel injector 22. Instead of an electromagnetic actuator, fuel injector 22 may also be provided with a piezoelectric or a magnetostrictive actuator. An annular groove 29, against which a contact surface 7 (see FIG. 2A) of installation/removal device 1 can abut, is formed between plug connector 28 and intermediate section 24. For purposes of removal, the installation/removal device is therefore slid over inclined guide elements 31 into groove 29 of fuel injector 22 and then locks into place in groove 29. For example, guide elements 31 may be five stiffening ribs, which are arranged circumferentially at the level of plug connector 28, and are injection molded along with it.

FIGS. 2A through 2D show, in detail, the first exemplary embodiment of the installation/removal device according to present invention, the installation/removal device being designated in general with reference numeral 1. The installation/removal device 1 includes a sheathing member 2 having a tubular section 4 and a contacting section 3, which includes two contacting subsections 3*a* and 3*b* that are arranged oppositely to each other, and separated from each other by cut-outs 11, 12. Contacting subsections 3*a*, 3*b* may be designed to be relatively narrow and, for example, each occupy an angular range of up to 90°. Together with contacting subsections 3*a* and 3*b*, contact surfaces 7*a* and 7*b*, which inwardly and are premolded to the front end of contact subsections 3*a*, 3*b* opposite to tubular section 4, form detent hooks that lock onto groove 29 on fuel injector 22. Contacting subsections 3*a*, 3*b* have an elasticity, so that their front ends can be moved elastically in the radial direction. Bordering on inwardly extending contact surfaces 7*a*, 7*b* are inclined deflectors 6, which slide over guide elements 31 on fuel injector 22, so that the front ends of contacting subsections 3*a*, 3*b* are pushed apart, and allow installation/removal device 1 to be easily attached for removing a fuel injector 22. Adjacent to deflectors 6 are plugs 5, which rest against a stop 32 on fuel injector 22, when installation/removal device 1 is in the engaged position. To mount fuel injector 22, compressive forces from installation/removal device 1 may be transmitted in this manner, via plugs 5, to fuel injector 22.

Figure 3A:
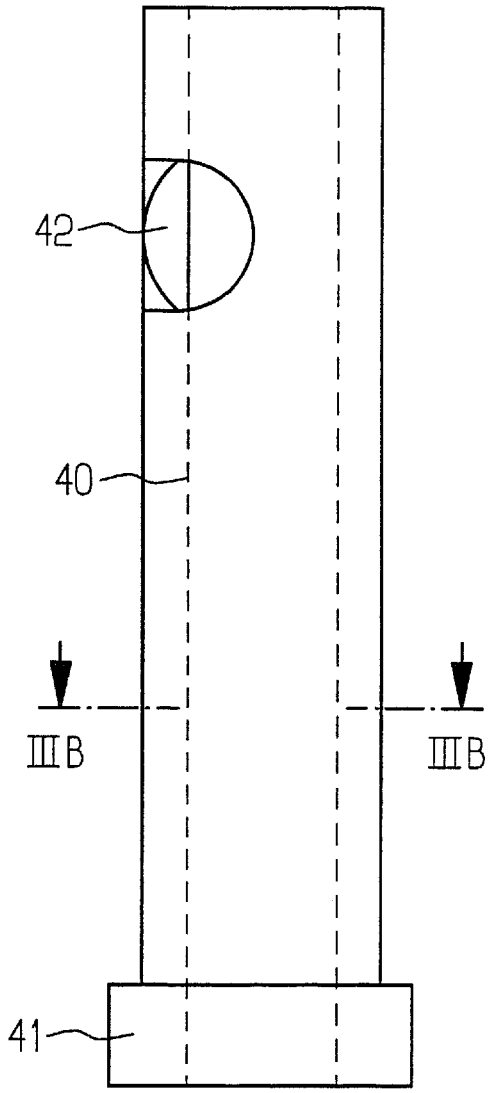
FIG. 3A is a side view of an inner section of the installation/removal device illustrated in FIGS. 1–2D.
Figure 3B:
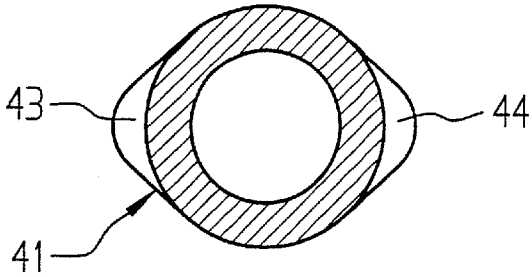
FIG. 3B is a sectional view of the inner section taken along the line IIIB—IIIB shown in FIG. 3A.
Figure 4:
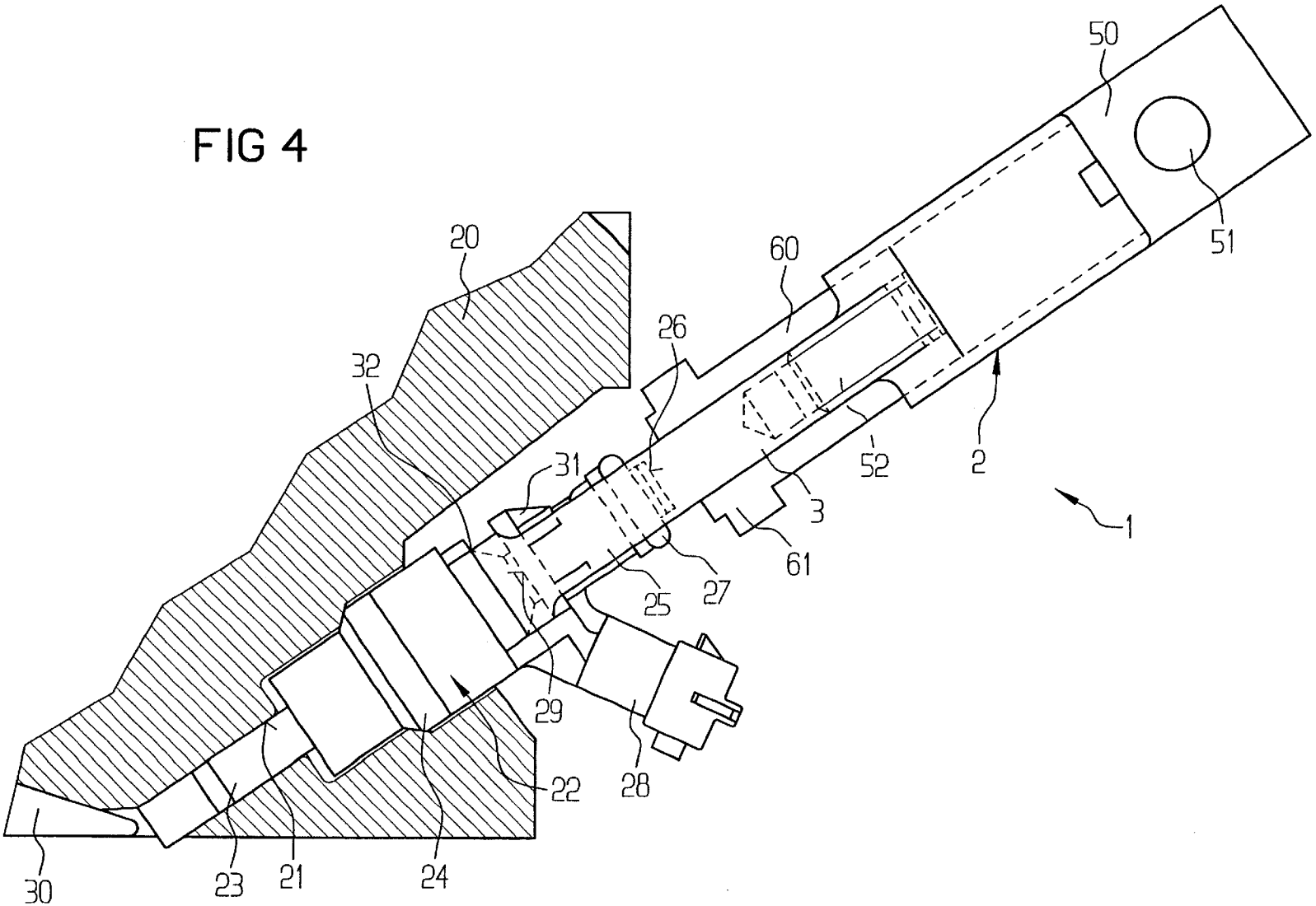
FIG. 4 is a side view of a second exemplary embodiment of an installation/removal device according to the present invention mounted on a fuel injector, which is inserted into a receiving bore hole of a cylinder head, shown in cross-section.
Figure 5A:
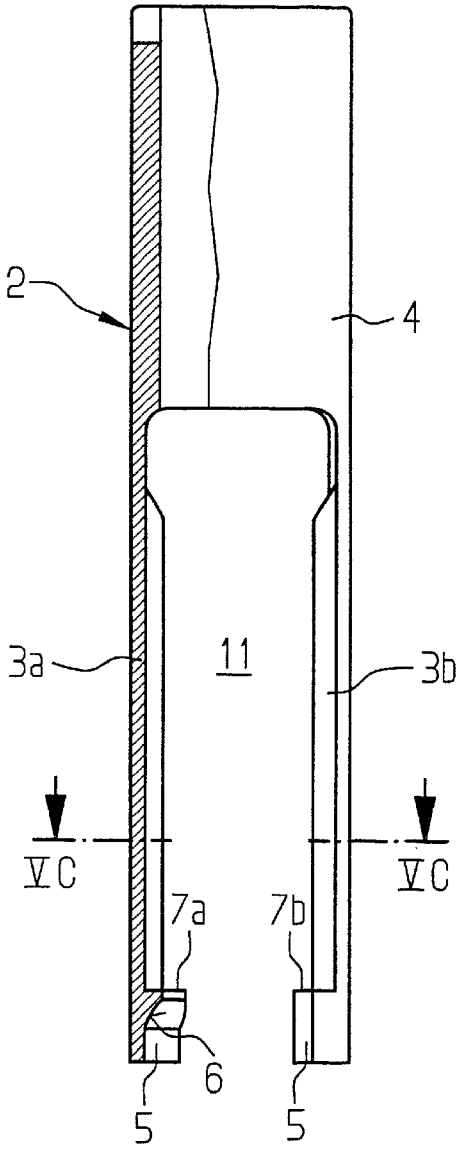
FIG. 5A is a front view, partially in section, of a sheathing member of the installation/removal device illustrated in FIG. 4.
Figure 5B:
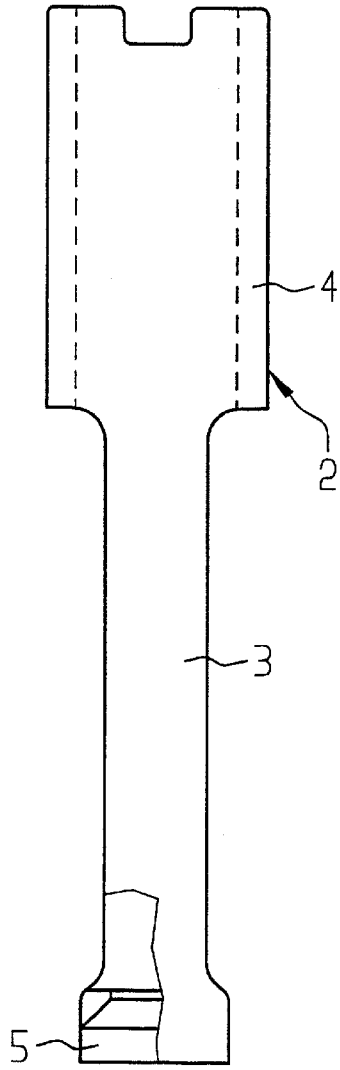
FIG. 5B is a side view of the sheathing member illustrated in FIG. 5A.
Figure 5C:
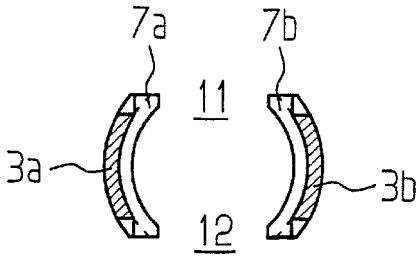
FIG. 5C is a sectional view of the sheathing member taken along the line VC—VC shown in FIG. 5A.
Figure 6A:
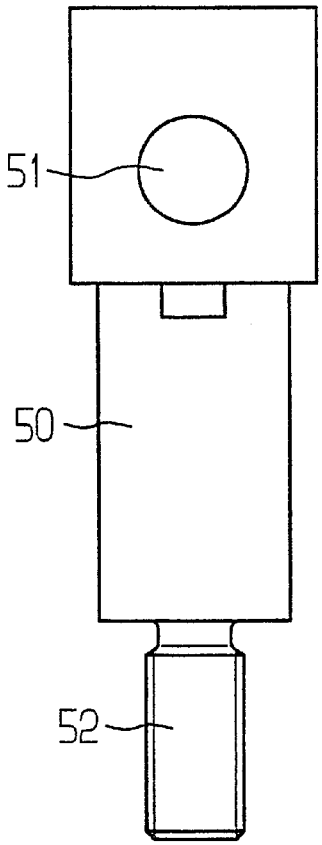
FIG. 6A is a side view of a gripping part of the installation/removal device illustrated in FIGS. 4–5C.
Figure 7A:
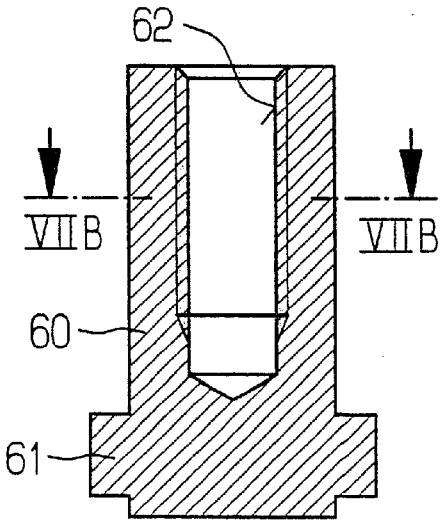
FIG. 7A is a cross-sectional view of a cam section of the installation/removal device illustrated in FIGS. 4–5C.
Figure 6B:
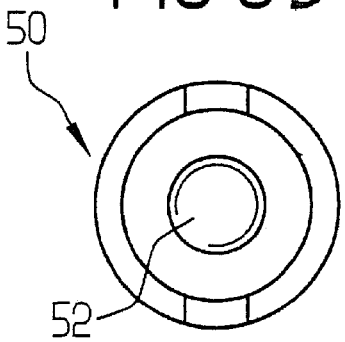
FIG. 6B is a bottom view of the gripping part illustrated in FIG. 6A.
Figure 7B:
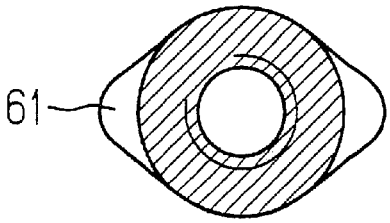
FIG. 7B is a sectional view of the cam section taken along the line VIIB—VIIB shown in FIG. 7A.

An exemplary embodiment of installation/removal device 1 according to the present invention is represented in FIGS. 1 through 3. The installation/removal device 1 includes an inner section 40 having a cam section 41, which can be inserted into sheathing member 2, and can rotate therein. As shown in FIG. 3*a*, the rear end of inner section 40, whose cross section is represented in FIG. 3*b*, has a bore hole 42, and the inner-section front end opposite to the rear end has a cam section 41. Twisting inner section 40 with respect to sheathing member 2 changes the angular position of cam section 41, which acts on elastic contact subsections 3*a*, 3*b*. In the initial state, inner section 40 is inside sheathing member 2 so, that two opposite cam ends 43, 44 extend into cut-outs 11 and 12. Thus, contacting subsections 3*a*, 3*b* can be bent apart and adjusted between an engaged position, in which a frictional connection to the fuel injector can be established, and a released position (indicated by a dot-dash line in FIG. 2A), in which installation/removal device 1 can be removed from fuel injector 22. In the released position, inner section 40 is inside sheathing member 2, e.g., twisted 90 degrees with respect to the engaged position.

The installation of a fuel injector 22 with the aid of installation/removal device 1 of the present invention may be performed as follows. Installation/removal device 1 is slid over fuel injector 22 to be mounted and locked into place with the aid of aforementioned deflectors 6, or installation/removal device 1 is attached to fuel injector 22 through operation of the adjusting mechanism, by rotating inner section 40. Using installation/removal device 1, fuel injector 22 can then be moved to receiving bore hole 21 in cylinder head 20, and can then be secured there by plugs 5. Contacting section 3 is then brought into its released position by rotating inner section 40 with respect to sheathing member 2, and installation/removal device 1 can easily be removed.

In order to rotate inner section 40 more easily with respect to sheathing member 2, the inner section 40 has two bore holes 42, and the sheathing member 2 has two oblong openings 10 for attaching a tool, such as a pin. This tool can be pushed through essentially opposing, oblong openings 10 in the wall of sheathing member 2, and through bore holes 42, and allows both parts of installation/removal device 1 to be twisted with a small amount of force. The two end positions of twistable tool 45 are represented schematically in FIG. 2D, by dashed lines.

For removal, device 1 is attached and locked into place, using the adjusting mechanism or guide elements 31 disposed on the outside of fuel injector 22. Contact surfaces 7*a*, 7*b* abut against groove 29 of fuel injector 22, so that tensile forces can be exerted and fuel injector 22 can be removed by installation/removal device 1. Finally, fuel injector 22 is released from installation/removal device 1 by use of the adjusting mechanism.

FIGS. 4 through 7 illustrated a second exemplary embodiment of installation/removal device 1 according to the present invention. Sheathing member 2 having tubular section 4 and contacting section 3 corresponds to the first exemplary embodiment, with the exception that no oblong openings 10 are provided in tubular section 4. Instead of inner section 40, a gripping part 50 and a cam section 60 are provided which, for example, are securely joined to each other by a screw connection. Gripping part 50 is designed altogether as a graded cylinder, and because of its graded design, it can be attached to the rear end of tubular section 4 of installation/removal device 1. The front end of gripping part 50 includes a connecting plug 52 having external threads for insertion into an internally threaded, axial, blind-end bore 62 of cam section 60. Cam section 60 has a cam segment 61, whose cross section is illustrated in FIG. 7B. While gripping part 50 can be attached to the rear end of tubular section 4 of installation/removal device 1, cam section 60 is inserted from the opposite end, between contacting subsections 3*a*, 3*b*, and is then locked into position by gripping part 50. Rotating gripping part 50 also causes cam segment 61 to rotate, which bends contacting section 3 upwardly, as in the first exemplary embodiment, and allows movement between an engaged position and a released position.

Therefore, the operation of the second exemplary embodiment represented in FIGS. 4 through 7 corresponds to that of the first exemplary embodiment represented in FIGS. 1 through 3, with the exception that the user can directly handle gripping part 50, and thus, more easily adjust between the engaged position and the released position. Two opposing bore holes 51 are also provided in gripping part 50 in order to attach a tool; such as a pin 45. However, it is not necessary to have oblong openings in tubular section 4, which means that the mechanical rigidity of installation/removal device 1 is increased.

What is claimed is:

1. An installation/removal device for installing a fuel injector in a receiving bore hole of an internal-combustion engine cylinder head and removing the fuel injector from the receiving bore hole, comprising:

a sheathing member including a tubular section and a contacting section, the contacting section being engageable with the fuel injector by a contact surface extending radially inwardly;

wherein the contacting section is adjustable between an engaged position, in which the contacting section is frictionally engageable with the fuel injector, and a released position, in which the installation/removal device is removable from the fuel injector; and wherein at least one deflector extending radially inwardly is attached to the contacting section.

2. The installation/removal device according to claim 1, wherein the contacting section includes at least two elastic contacting subsections separated from each other by cutouts, the subsections being deformable in a radial direction by an adjusting mechanism.

3. The installation/removal device according to claim 2, further comprising an adjusting mechanism, the adjusting mechanism including an inner section, the inner section being insertable into the sheathing member, the inner section being rotatable with respect to the sheathing member, and the inner section having a cam section acting on the contacting subsections.

4. The installation/removal device according to claim 3, wherein the inner section includes at least one bore hole and the tubular section includes at least one oblong opening, the bore hole and oblong opening being attachable to a tool.

5. The installation/removal device according to claim 4, wherein the tool includes a pin, the bore hole and oblong opening being attachable to the pin.

6. The installation/removal device according to claim 2, further comprising an adjusting mechanism, the adjusting mechanism including a gripping part and a cam section, the gripping part being attachable to the tubular section and being rotatable with respect to the tubular section, the cam section being detachably connected to the gripping part and acting on the contacting subsections.

7. The installation/removal device according to claim 6, wherein the gripping part includes at least one bore hole attachable to a tool.

8. The installation/removal device according to claim 2, wherein at least one plug is provided at a front end of the contacting subsections, the plugs being configured to axially support the installation/removal device at a housing of the fuel injector during installation.

9. The installation/removal device according to claim 2, wherein the at least one deflector has an inclined deflector element which is attached to an inner radial side of the contacting subsections, the inclined deflector element being configured to provide support at guide surfaces located on an outside of the fuel injector, the inclined deflector element being configured to deform the contacting subsections radially outwardly.

10. The installation/removal device according to claim 1, wherein the installation/removal device is formed of a material selected from a group consisting of sheet metal and fiberglass-reinforced plastic.

* * * * *